US009549575B2

(12) United States Patent
Magliocchetti

(10) Patent No.: US 9,549,575 B2
(45) Date of Patent: Jan. 24, 2017

(54) BRASSIERE WITH CONCEALABLE SHIRT SLEEVE RETAINING LOOP

(71) Applicant: ACTIV LOOPS LLC, Tampa, FL (US)

(72) Inventor: Jennifer Magliocchetti, Tampa, FL (US)

(73) Assignee: ACTIV LOOPS LLC, Tampa, FL (US)

( * ) Notice: Subject to any disclaimer, the term of this patent is extended or adjusted under 35 U.S.C. 154(b) by 0 days.

(21) Appl. No.: 14/600,867

(22) Filed: Jan. 20, 2015

(65) Prior Publication Data

US 2015/0133027 A1 May 14, 2015

Related U.S. Application Data

(63) Continuation of application No. 13/956,778, filed on Aug. 1, 2013, now Pat. No. 8,961,263.

(60) Provisional application No. 61/678,413, filed on Aug. 1, 2012.

(51) Int. Cl.

| | |
|---|---|
| ***A41C 3/08*** | (2006.01) |
| ***A41C 3/12*** | (2006.01) |
| ***A41F 19/00*** | (2006.01) |

(52) U.S. Cl.

CPC . *A41C 3/08* (2013.01); *A41C 3/12* (2013.01); *A41F 19/005* (2013.01)

(58) Field of Classification Search

CPC ..... A41C 1/00; A41C 3/00; A41C 3/12; A41F 9/005

USPC ..... 450/81, 88, 86; 2/69, 269, 104–106, 2/113–115, 170, 270, 271, 912, 920, 232, 2/80, 74

See application file for complete search history.

(56) References Cited

U.S. PATENT DOCUMENTS

| | | | |
|---|---|---|---|
| 1,510,388 | A | 9/1924 | Darling |
| 2,264,972 | A | 12/1941 | Greenberg |
| 2,364,422 | A | 12/1944 | Brooks |
| 3,086,529 | A | 4/1963 | Munz et al. |
| 4,289,137 | A | 9/1981 | Dell et al. |
| 4,384,583 | A | 5/1983 | Speelman et al. |
| 4,475,252 | A | 10/1984 | Peyser et al. |
| 4,583,544 | A | 4/1986 | Flanagan et al. |
| 4,816,005 | A | 3/1989 | Braaten |
| 4,917,651 | A | 4/1990 | Rainville |
| 5,033,986 | A | 7/1991 | Feigenbaum et al. |
| 5,172,428 | A | 12/1992 | Leinoff |
| 5,293,646 | A | 3/1994 | Winston |
| 5,692,239 | A | 12/1997 | Lewis |
| 5,787,511 | A | 8/1998 | Garside |
| 5,820,445 | A | 10/1998 | Smith et al. |
| 5,823,851 | A | 10/1998 | Dicker |

(Continued)

*Primary Examiner* — Gloria Hale

(74) *Attorney, Agent, or Firm* — Buchanan Ingersoll & Rooney PC

(57) ABSTRACT

A sleeve material retaining loop is attached to or looped around a strap of a brassiere to retain gathered sleeve material or other items. One end of the sleeve material retaining loop extends out of the neck hole of the outer garment, and another end of the loop extends out of the arm hole of the sleeve above the shoulder of the wearer. The first and second ends of the sleeve material retaining loop are attached at the shoulder of the wearer to retain the sleeve. This helps prevent the sleeve from interfering with the wearer's movement and improves evaporative cooling of the wearer. A sleeve retaining loop storing mechanism stores the loop. Each sleeve retaining loop may be formed of separate interchangeable pieces that are attached to the brassiere. An additional piece of clothing may also be secured to a fastener on the brassiere.

20 Claims, 2 Drawing Sheets

(56) References Cited

U.S. PATENT DOCUMENTS

| | | | | |
|---|---|---|---|---|
| 6,146,239 | A | 11/2000 | Magliocchetti | |
| 8,961,263 | B2 * | 2/2015 | Magliocchetti | A41F 19/005 2/105 |

* cited by examiner

BRASSIERE WITH CONCEALABLE SHIRT SLEEVE RETAINING LOOP

RELATED APPLICATION

This applications claims the priority benefit of commonly assigned U.S. Provisional Application No. 61/678,413, filed on Aug. 1, 2012, for "Brassiere with Concealable Shirt Sleeve Retaining Loop," by Jennifer Magliocchetti, incorporated by reference herein. This application is a continuation of U.S. application Ser. No. 13/956,778 filed on Aug. 1, 2013, for "Brassiere with Concealable Shirt Sleeve Retaining Loop," by Jennifer Magliocchetti.

BACKGROUND OF THE INVENTION

Field

The presently disclosed brassiere relates to athletic clothing, and in particular, to a brassiere having a concealable shirt retaining band or loop for selectively retaining a gathered shirt sleeve at the wearer's shoulder.

Discussion of Related Art

Sleeved garments such as tee-shirts, shirts, and blouses (hereinafter referred to collectively as "shirts") are common items of apparel. However, in some instances, the sleeves of such garments can interfere with the wearer's athletic activities and cause overheating. Shirt sleeves can interfere with the arm movement of the wearer and increase heat retention during indoor and outdoor athletic activities. For instance, U.S. Pat. No. 5,692,239 to Donald Lewis discloses a sleeve holder in the form of an epaulet with a hook and loop (VELCRO™) on a loose end thereof. The hook and loop fastener is attachable to either the shoulder or to a matching fastener lower on the sleeve. By pulling up the sleeve and attaching the epaulet to the lower fastener, the sleeve can be retained in a drawn-up position. See, also U.S. Pat. No. 4,475,252 to Peyser. However, these mechanisms are suitable only for shirts on which epaulets are appropriate, and not athletic wear suitable for aerobic activity.

Also, by covering more skin surface, particularly the underarms, shirt sleeves can unduly cause overheating of the athlete. Women tend to suffer more from this problem insofar as brassieres, or bras, particularly sports bras such as disclosed in U.S. Pat. No. 4,583,544 to Cherrie Flanagan et al., are commonly worn. The additional material of the brassiere adds to the wearer's heat retention.

These problems are particularly apparent in organized sports such as collegiate soccer, softball, and lacrosse, where the participants are required to wear sleeved outer garments to distinguish team members and due to puritan sensibilities. Female athletes often gather up the short sleeves of their outer athletic wear, which can prove irritating insofar as the sleeves tend to slip down the athlete's arms and have to be re-gathered.

These problems were largely alleviated by providing a brassiere with a shirt sleeve retaining loop, as disclosed in U.S. Pat. No. 6,146,239 to Jennifer Magliocchetti. However, when the sleeve retaining loop is not engaged, it can be noticeable through the outer garment and might reduce the aesthetics of certain outfits.

SUMMARY

The presently disclosed brassiere can provide a convenient mechanism for selectively retaining shirt sleeves in the gathered position at the wearer's shoulder without creating an unsightly bulge or line when not used to gather sleeves.

Rather, the brassiere can look like a normal brassiere in certain embodiments until the sleeve retaining loops are used to retain a sleeve, thus making the brassiere a more versatile substitute for a regular bra. The presently disclosed brassiere solves the foregoing problems of the prior art by providing a mechanism whereby sleeves gathered up can be retained in place by a loop of material, at least one end of which contains a fastener for connecting each end of a strap of material to form a loop. The looped material is fastened together as a loop encircling the material between the neck hole and end of the sleeve of the shirt. The loop of material is preferably attached to a shoulder strap of a brassiere. Additionally, the sleeve gathering mechanism can be secured to obscure its presence when not employed to retain a sleeve.

Several embodiments of the presently disclosed brassiere are shown which include various fastening means of the ends of the looped material, various mechanisms for attaching the loop of material to the bra, and methods of employing same.

Additionally, modifications to the loops of materials are described which can help provide a convenient mechanism for securing other loose items to the wearer without creating an unsightly bulge or line when not used to secure other loose items.

BRIEF DESCRIPTION OF THE DRAWINGS

The presently disclosed brassiere will now be described by way of exemplary embodiments, to which it is not limited, as illustrated in the accompanying drawings in which.

DETAILED DESCRIPTION

Figure 1:
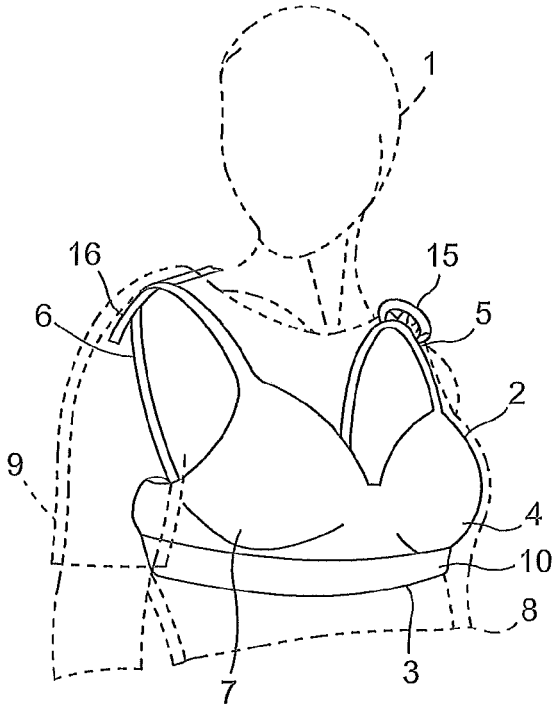
FIG. 1 is a view showing a brassiere with sleeve retaining loops in accordance with the presently disclosed brassiere.

Referring to FIG. 1, a wearer 1 of a brassiere 2 incorporating the presently disclosed brassiere includes a continuous, uninterrupted front panel 3 including first and second breast retaining portions 4 and 7. Attached to the first and second breast retaining portions 4 and 7 are first and second straps 5 and 6 which travel over respective shoulders of the wearer to the rear panel (not shown) of the brassiere 2. An elastic band 10 continues around the torso of the wearer 1 and is attached to the bottom edges of the front panel 3 and the rear panel (not shown).

The particular construction of the brassiere 2 is preferred but not essential to the presently disclosed brassiere. The presently disclosed brassiere can be embodied in brassieres having brassiere cups, underbra support wires, or nearly any other type of undergarment having shoulder straps.

A shirt 8 (shown in phantom) has sleeves 9. The left sleeve 9 is illustrated in an extended position, extending down the wearer's arm. The right sleeve 9 is illustrated in a gathered state at the top of the wearer's shoulder.

The presently disclosed brassiere 2 is embodied by first and second elongated loops of material 15, 16 which are attached to or looped around the first and second shoulder straps 5, 6. The first and second elongated loops of material 15, 16 are formed by loop straps. An axis of the first and second loops of material 15, 16 formed by the loop straps is attached to the brassiere straps 5, 6, respectively, such that the axis of the loops is non-parallel to the axis of the brassiere straps 5, 6, and is preferably generally perpendicular thereto within a range of movement permitted by the brassiere 2 and the shirt 8. Subsequent references to the first and second loops 15, 16 should be understood to reference the straps that form the first and second loops 15, 16, where appropriate.

The first and second loops of material 15, 16 include a first end and a second end. At least one of the first and second ends has a garment fastener which fastens the first end to the second end. The first and second loops of material 15, 16 have a sufficient length to loop around the material existing between the neck hole and the arm hole at the end of the sleeve 9 of the outer garment or shirt 8 worn by the wearer 1 on top of the brassiere 2. In this way, the sleeves 9 are gathered and bunched at the shoulders of the wearer 1, comfortably out of the wearer's way, to expose more surface area of the wearer's skin, particularly around the underarms, to permit greater heat exchange and body cooling.

As illustrated, first and second retaining loops 15, 16 are provided, one for each sleeve. Naturally, if there is a particular need, only one loop may be supplied or used. Also, as explained in more detail below, the first and second sleeve retaining loops 15, 16 can be permanently fastened to the brassiere 2, or made detachable.

Figure 2A:
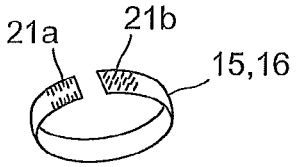
FIGS. 2(A)-2(C) show embodiments of the presently disclosed brassiere including various examples of garment fasteners in the form of hook and loop fabric strips.
Figure 2B:
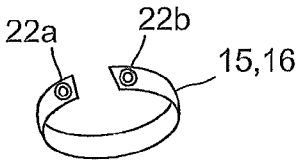
Figure 2C:
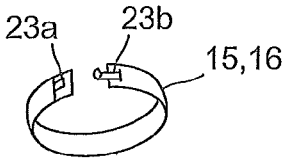

FIG. 2(A) shows a first embodiment of the sleeve retaining loops 15 and 16. As shown in FIG. 2(A), hook and loop fabric strips 21*a*, 21*b* are used at the first and second ends of the loop of material. Hook and loop fabric strips, commonly known by the trademark VELCRO™, is illustrated as the material, which is a relatively inexpensive garment fastener which can be used to adjust the overlap of the first and second ends of the first and second loops 15, 16, respectively, to gather the shirt material tightly or loosely, and can accommodate various amounts of the shirt material.

Figure 3A:
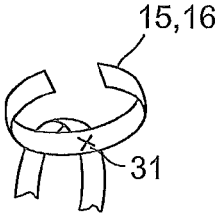
FIGS. 3(A)-3(C) show embodiments of the presently disclosed brassiere including various ways to secure the retaining loop to a brassiere strap.

While the sleeve retaining loop material is preferably relatively soft, the hook and loop fastener material 21*a*, 21*b* can be chafing. In such a case, one or both of the first and second loops 15, 16 is preferably fastened to the brassiere 2 in a convenient manner to prevent the loop ends of the garment fastener from rotating against the wearer's skin. For instance, the first and second retaining loops 15, 16 can be fastened to the brassiere 2 by an additional fastening means, such as sewing the retaining loops 15, 16 to the respective brassiere straps 5, 6 of the brassiere 2 by stitching 31 as shown in FIG. 3(A), or on the underside respective brassiere straps 5, 6. In other words, the first and second retaining loops 15, 16 can be manufactured as an integral part of the brassiere 2. In addition to stitching 31, snaps (FIG. 3(B)), hook and loop fabric strips, and hooks and eyelets could be used, as could nearly any other suitable clothing fastener.

Figure 3B:
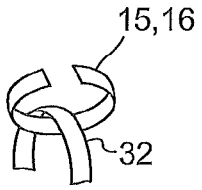
Figure 3C:
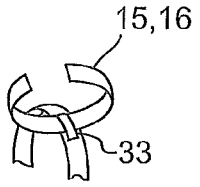

Additionally, the first and second retaining loops 15, 16 can simply be placed underneath respective brassiere straps 5, 6 without a fastener between the brassiere straps 5, 6 and the loops 15, 16, as shown in FIG. 3(B). The first and second retaining loops 15, 16 can be used without attachment to the brassiere 2 or even under the brassiere straps 5, 6. However, these embodiments permit rotation of the first and second retaining loops 15, 16 which can expose the skin to a chafing surface of the first and second retaining loops 15, 16.

One solution for preventing the exposure of the skin to a chafing surface of the first and second retaining loops 15, 16 includes the use of an additional strap loop 33 of material on top of or on the underside of the brassiere straps 5, 6. This will serve to secure the first and second retaining loops 15, 16 and permit rotation of the first and second retaining loops 15, 16 while minimizing chafing because the brassiere straps 5, 6 act as a shield and guide to the first and second retaining loops 15, 16. The wearer 1 of this preferred embodiment may then fasten the fastener of the first and second retaining loops 15, 16 on top of the shirt, rotate one or both ends out-of-sight under the gathered sleeve material, and then fasten the additional strap loop 33 of material on top of or on the underside of the brassiere straps 5, 6.

The hook portion of the hook and loop fabric connectors 21*a*, 21*b* at the ends of the first and second retaining loops 15, 16 should be on the surface of first and second retaining loops 15, 16 away from the wearer's body, when not in use. This will reduce chafing, even when the first and second retaining loops 15, 16 are not engaged and the sleeves 9 are permitted to extend down the wearer's arm or torso.

Modifications of the presently disclosed brassiere include using various garment fasteners such as use of a button and a button hole with the button preferably on the upper surface of the brassiere strap 5, 6 on the surface of the first and second retaining loops 15, 16 away from the wearer's body when not in use. Naturally, clasps, buckles and slip sleeves can be employed effectively, as can nearly any suitable form of clothing fastener.

In use, the wearer of a sleeved outer garment 8 simply gathers up a sleeve 9, grabs one end of a sleeve retaining loop (e.g., first retaining loop 15) found underneath the sleeve 9, and the other end of the loop 15 through the neck opening of the outer garment 8, and fastens the two ends of the retaining loop 15 together to retain the bunched-up sleeve material. This process is done either before or after the retaining loop 15 is attached to the brassiere if attachment is desired.

Additionally, the first and second retaining loops 15, 16 can simply be brought underneath respective brassiere straps 5, 6 and no fastener employed as shown in FIG. 3(B). By attaching the first and second retaining loops 15, 16 to the brassiere 2, the shirt material is gathered and retained at approximately the position of the brassiere straps 5, 6, which, in sports bras, is relatively fixed even when the athlete is energetically moving. This reduces chafing by the gathered shirt material. However, the first and second loops 15, 16 can be used without attachment or being looped around respective brassiere straps. Also, it is possible to simply tie two ends of a retaining loop 15, 16 together, rather than employ a fastener.

Figure 4A:
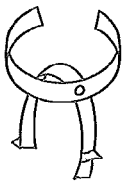
FIGS. 4(A)-4(C) show embodiments of the presently disclosed brassiere including various ways to secure the ends of the retaining loop when not being used to retain a gathered shirt sleeve.
Figure 4B:
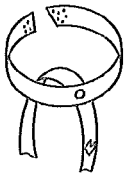
Figure 4C:
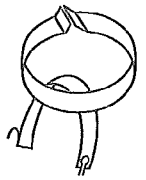

As shown in FIGS. 4A, 4B and 4C, the ends of the first and second retaining loops 15, 16 can be secured in parallel to respective brassiere straps 5, 6 so as to be less intrusive when not in service. That is, the brassiere 2 can look more or less normal when the first and second retaining loops 15, 16 are not being employed to gather the sleeves of a shirt. For instance, as shown in FIG. 4A, the first and second retaining loops 15, 16 can be fastened to respective brassiere straps 5, 6 by a fastener that that permits rotation. Suitable fasteners include a simple button and buttonhole, or a snap button or any suitable clothing fastener capable of disengagingly fastening the brassiere straps 5, 6 and to respective first and second retaining loops 15, 16, but axially joined so that the materials of the straps 5, 6 and the loops 15, 16 can be rotated relative to each other. The fastener can be on the underside of the brassiere straps 5, 6 or more preferably on top, and may be fabric-coated to prevent discomfort and for aesthetics. Alternatively, the first and second retaining loops 15, 16 can be made of a material that permits the loops 15, 16 to be placed in line with the brassiere straps 5, 6 without creating a noticeable bulge, such as strings or cords, particularly those that can be tucked under respective brassiere straps 5, 6.

When the first and second retaining loops 15, 16 are rotated to be in the same plane as formed by the axis of a brassiere straps 5, 6, they can be fastened to respective brassiere straps 5, 6 with one end of the loops 15, 16 being fastened to the front of the brassiere 2 and the other end fastened to the back of the brassiere 2. As shown in FIG. 4(A), the ends of the first and second retaining loops 15, 16 are simply trapped by a loop of additional material 34 and 35. As shown in FIG. 4(B), an alternative would be to provide hook and loop material in the front part and the back part of the brassiere straps 5, 6 so that the hook and loop material used in the first and second retaining loops 15, 16 can be secured thereby to the brassiere faces. As will be apparent, at least one of the ends of the first and second retaining loops 15, 16 might have hook or loop material on both sides. Alternatively, the hook and loop material can appear on one side of the sleeve retaining loop but when used to retain a sleeve, could be twisted so that the mating surfaces of the hook and loop material would engage.

As shown in FIG. 4C, hooks and eyelets can be used to engage the ends of the first and second retaining loops 15, 16 to mate hook and loops on the brassiere strap 5, 6 by respective front and back portions.

Modifications of these embodiments include that the fasteners appear only on the front or back of the brassiere 2 on the strap so that both ends of the first and second retaining loops 15, 16 are engaged to the brassiere straps 5, 6 at one side, preferably the front side insofar as the wearer could more readily attach the two ends of the first and second retaining loops 15, 16 to the front of the brassiere 2. Also, though illustrated as being fastened on the top surface of the brassiere 2, the fasteners can be on the underside of the brassiere 2.

Another modification of these embodiments include first and second retaining loops 15, 16 that allow for ruching of the retaining loops 15, 16. This allows for the wearer 1 to gather excess fabric of the first and second retaining loops 15, 16 so that the sleeve is secured by the retaining loops 15, 16.

A further modification of these embodiments include attaching first ends of the first and second retaining loops 15, 16 to the brassiere 2 and then attaching second ends of the first and second retaining loops 15, 16 to the brassiere 2 using a fastener that is different from the fastener attached to the first ends of the first and second retaining loops 15, 16. In other words, the first and second ends of each of the first and second retaining loops 15, 16 need not be attached to each other. Instead, the first and second ends of the first and second retaining loops 15, 16 may be attached to different portions of the brassiere straps 5, 6.

Figure 5:
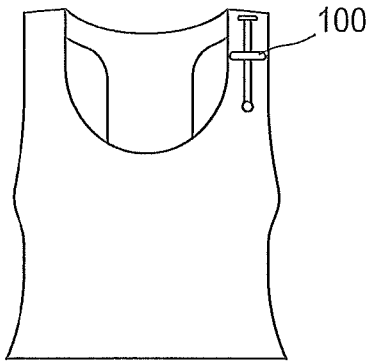
FIG. 5 shows an embodiment of the presently disclosed brassiere that includes material for securing other items to the brassiere.
Figure 6:
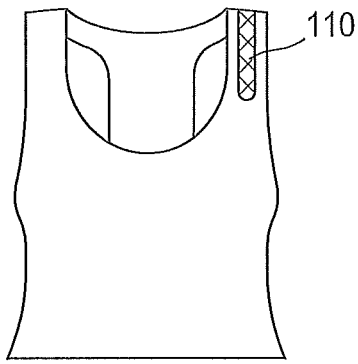
FIG. 6 shows an embodiment of the presently disclosed brassiere that includes a zipper.

The first and second retaining loops 15, 16 may also include other desirable features. For example, the first and second retaining loops 15, 16 may be decorated with ornamental or other aesthetically distinguishing features such as coloring, patterns, rhinestones, logos, and the like. The first and second retaining loops 15, 16 may also contain materials that provide desirable effects in the wearer 1. For example, the retaining loops 15, 16 may be a titanium-filled nylon necklace that may provide physiological benefits to the wearer 1. The first and second retaining loops 15, 16 may further include a heart rate monitor, a calorie counter, a pedometer, and other devices. The first and second retaining loops 15, 16 may also include loops or other features that help associate the retaining loops 15, 16 with other items that may interfere with athletic activities if not appropriately secured. One example is shown in FIG. 5, which depicts material 100 that helps secure an item like a headphone cable to the brassiere 2. In another preferred embodiment, shown in FIG. 6, a zipper may be formed on the retaining loops 15, 16 that correspond to a zipper 110 formed on the brassiere straps 5, 6. The zipper 110 of the retaining loops 15, 16 engages with the zipper of the brassiere straps 5, 6 to secure the retaining loops 15, 16 to the brassiere straps 5, 6.

Figure 7A:
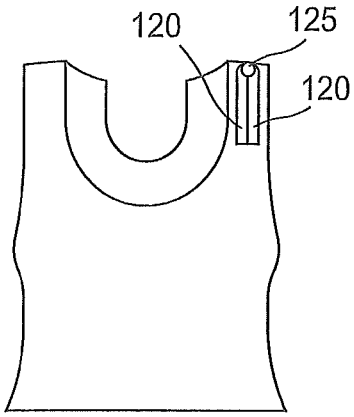
FIGS. 7A-7B show an embodiment of the presently disclosed brassiere that includes two separate pieces to form a retaining loop.
Figure 7B:
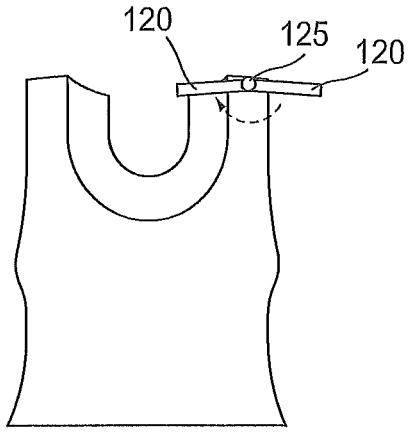

The first and second retaining loops 15, 16 may also be formed of two separate pieces 120 that are independently attached to the brassiere straps 5, 6 in an independently rotatable manner. The separate pieces 120 may be made of different materials with different properties. In a preferred embodiment, the separate pieces 120 of the retaining loops 15, 16 are independently attached to the brassiere straps 5, 6 so that the separate pieces 120 of the retaining loops 15, 16 may independently rotate with respect to the brassiere straps 5, 6. This embodiment is depicted in FIGS. 7A and 7B. The separate pieces 120 of the retaining loops 15, 16 may then be rotated to extend substantially perpendicular to the axis of the brassiere straps 5, 6. The ends of each of the retaining loops 15, 16 formed from the separate pieces 120 may then be secured to each other to retain a sleeve or other loose item. Each separate piece 120 of the retaining loops 15, 16 may be interchangeable with another separate piece 120 of the retaining loops 15, 16 so that the wearer 1 may customize the particular materials used in each of the retaining loops 15, 16.

One preferred embodiment includes one piece 120 of the first and second retaining loops 15, 16 including light reflective or glow-in-the-dark material to improve the visibility of the wearer in low-light conditions. Another embodiment includes one piece 120 of the first and second retaining loops 15, 16 that helps indicate the wearer's current condition. For example, one piece 120 of the first and second retaining loops 15, 16 may indicate with color the wearer's approximate body temperature.

Although fabric is shown in the embodiments, other materials such as elastic bands could be used. In this case, because the elastic bands are flexible, it would not be necessary to have a fastener that permits rotation between the first and second loops 15, 16 and the brassiere straps 5, 6. Instead, the fastener can be fixed and the elastic material simply stretched around a sleeve when functioning as a sleeve retaining loop, or can be attached to the brassiere strap 5, 6 by simply rotating the material to be more in plane with the brassiere strap 5, 6.

Yet another modification would be to have a pocket formed in the brassiere straps 5, 6, either on the outer surface of the brassiere straps 5, 6, or against the wearer's skin. One mechanism is to have each edge of the straps 5, 6 be of a slightly smaller length than the center portion of the brassiere straps 5, 6 in a linear direction of the brassiere strap so that the first and second retaining loops 15, 16 would be trapped underneath the brassiere strap 5, 6 for a smooth appearance, when the first and second retaining loops 15, 16 are not being used to gather a sleeve. In this instance, it would be preferred that the first and second retaining loops 15, 16 be fastened to the underside of the brassiere strap 5, 6.

Figure 8A:
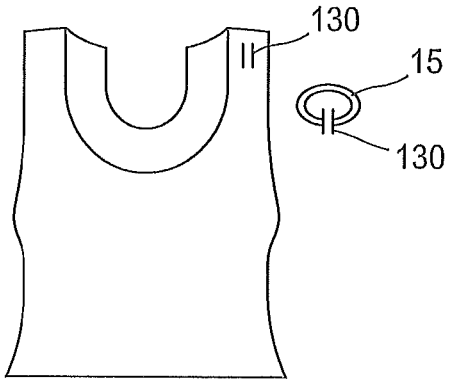
FIGS. 8A-8B show an embodiment of the presently disclosed brassiere that includes slits.

Additionally, slits 130 can be formed in the brassiere strap material, particularly when the brassiere strap material has multiple layers. In this way, the first and second retaining loops 15, 16 can be inserted into respective slits 130 in the brassiere straps 5, 6, such that they become trapped in the material of the brassiere straps 5, 6. This particular embodiment is advantageous when the fasteners of the first and second retaining loops 15, 16 are somewhat rigid at least in part at the ends so that insertion can be easily achieved. The slits 130 may be positioned on the outer surface of the brassiere straps 5, 6 or on the underside of the brassiere straps 5, 6 depending on aesthetic and wearer comfort concerns. One examples of such an embodiment are illustrated in FIG. 8A which shows a brassiere with multiple slits 130. A retaining loop 15 is inserted into the slits 130 so that the retaining loop 15 is secured to the brassiere.

Figure 8B:
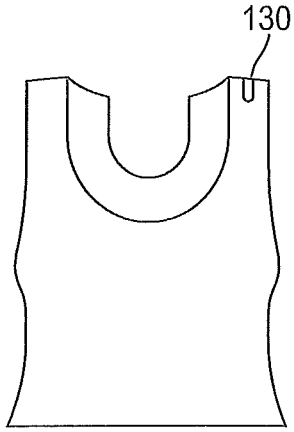

A further modification modifies the slits 130 cut into the brassiere straps 5, 6 so that the slit in the brassiere straps 5, 6 secure loose items that are not held by the first or second retaining loop 15, 16. For example, in a preferred embodiment a slit is formed on the top of the brassiere straps 5, 6 so that a portion of a headphone cable may be secured to the brassiere 2. This helps reduce the interference from loose items while the wearer 1 is performing activities. FIG. 8B illustrates a brassiere with such a single slit 130 suitable for securing a portion of a headphone cable or another loose item.

In yet another modification, the brassiere straps 5, 6 may include fasteners 125 that are configured to directly secure an article of clothing to the brassiere 2. One way this may be accomplished is with articles of clothing that include a feature that corresponds to a securing feature 125 of the brassiere 2. This article of clothing may then be directly secured to the securing feature 125 of the brassiere 2 without requiring the use of the first and second retaining loops 15, 16. In a preferred embodiment, the securing feature 125 of the brassiere 2 can secure either the first and second retaining loops 15, 16 or an article of clothing with a feature that corresponds to the brassiere 2 securing feature 125. For example, the brassiere 2 may include a snap 125 that corresponds to a snap on the retaining loops 15, 16. In this example, the snap 125 also corresponds to a snap on a separate article of clothing that may be directly secured to the brassiere 2.

The presently disclosed brassiere has been described by way of the foregoing embodiments. However, modifications and variations will occur to those skilled in the art without deviating from the spirit and scope of the presently disclosed brassiere. For instance, while various garment fasteners have been described, doubtless other garment fasteners can be employed. Additionally, while the fabric of the first and second retaining loops 15, 16 can be nylon, cotton, polyester, spandex or any fabric or blends thereof suitable for garment construction, doubtless other materials could be employed such as plastics or other non-woven materials. While the presently disclosed brassiere has been principally described as being useful for athletic wear such as tee-shirts, it will be appreciated that the presently disclosed brassiere is useful for garments used for other purposes such as gardening, fitness activities including active and leisure workouts, charity walks, and the like. The scope of the invention should be determined the claims appended hereto and equivalents thereof.

What is claimed is:

1. A brassiere, comprising:

a front panel including first and second breast retaining portions;

a rear panel configured to attach to said front panel, said front and rear panels cooperating to define a torso aperture;

a first shoulder strap configured to attach said first breast retaining portion and said rear panel, said first shoulder strap cooperating with said first breast retaining portion and said rear panel to define a first arm aperture;

a second shoulder strap configured to attach said second breast retaining portion and said rear panel, said second shoulder strap cooperating with said second breast retaining portion and said rear panel to define a second arm aperture;

wherein said first and second shoulder straps, said front panel, and said rear panel cooperate to define a head aperture;

a first set of straps associated with said first shoulder strap configured to cooperatively form a first elongated loop; and a loop storing mechanism configured to store and conceal the first set of straps, wherein said first elongated loop formed by said first set of straps is arranged between said first arm aperture and said head aperture, wherein one strap of said first set of straps fastens to another strap of said first set of straps to form said first elongated loop, and wherein said first elongated loop is configured to secure at least a portion of clothing material worn on top of said brassiere between said head aperture and said first arm aperture.

2. A brassiere according to claim 1, further including an elastic understrap extending around an entire torso of the wearer.

3. A brassiere according to claim 1, further comprising a second set of straps associated with said second shoulder strap configured to cooperatively form a second elongated loop;

wherein said second elongated loop formed by said second set of straps is arranged between said second arm aperture and said head aperture;

wherein one strap of said second set of straps fastens to another strap of said second set of straps to form said second elongated loop; and wherein said second elongated loop is configured to secure at least another portion of clothing material worn on top of said brassiere between said head aperture and said second arm aperture.

4. A brassiere in accordance with claim 1, wherein said first set of straps is fastened to said first shoulder strap.

5. A brassiere in accordance with claim 4, wherein said first set of straps is fastened to said first shoulder strap using a garment fastener selected from the group consisting of stitching, hook and loop fabric strips, a loop of material attached to said first shoulder strap, snaps, button holes, wire hooks and loops, and clasps.

6. A brassiere in accordance with claim 1, wherein said one strap of said first set of straps fastens to said another strap of said first set of straps using a fastener selected from the group consisting of hook and loop fabric strips, snaps, buttons and button holes, slip sleeves, clasps, wire hooks and loops, zippers, and buckles.

7. A brassiere in accordance with claim 3, wherein said loop storing mechanism includes a fastener on at least a front or rear portion of said first or second shoulder strap configured to engage with at least one of the first and second set of straps.

8. A brassiere in accordance with claim 7, wherein said fastener of the loop storing mechanism is one of a group consisting of hook and loop fabric strips, snaps, buttons and button holes, slip sleeves, clasps, wire hooks and loops, zippers, and buckles.

9. A brassiere in accordance with claim 3, wherein at least one of said first and second set of straps is formed by separate pieces rotatably attached at one end to one of said first and second shoulder straps.

10. A brassiere in accordance with claim 4, wherein said first shoulder strap is further configured to attach to a separate article of clothing.

11. A brassiere according to claim 1, wherein the first set of straps includes a portion configured to secure items to the brassiere.

12. A brassiere according to claim 1, wherein the portion of the first set of straps securing items to the brassiere comprises a loop.

13. A brassiere according to claim 11, wherein the items are at least one of a heart rate monitor, a calorie counter, a pedometer, and a headphone cable.

14. A brassiere according to claim 1, wherein the first set of straps comprises light reflective or light-emitting material improving the visibility of the wearer in low-light conditions.

15. A brassiere according to claim 3, wherein at least one of the first set of straps or the second set of straps includes a portion configured to secure items to the brassiere.

16. A brassiere according to claim 3, wherein the portion of the first set of straps or the second set of straps securing items to the brassiere comprises a loop.

17. A brassiere according to claim 3, wherein at least one of the first set of straps and the second set of straps comprises light reflective or light-emitting material improving the visibility of the wearer in low-light conditions.

18. A brassiere according to claim 1, wherein at least one of the first set of straps and the second set of straps comprises coloring, patterns, rhinestones, and/or logos.

19. A brassiere, comprising:

a front panel including first and second breast retaining portions;

a rear panel configured to attach to said front panel, said front and rear panels cooperating to define a torso aperture;

a first shoulder strap configured to attach said first breast retaining portions and said rear panel, said first shoulder strap cooperating with said first breast retaining portion and said rear panel to define a first arm aperture;

a second shoulder strap configured to attach said second breast retaining portion and said rear panel, said second shoulder strap cooperating with said second breast retaining portion and said rear panel to define a second arm aperture through which another arm of a wearer extends;

wherein said first and second shoulder straps, said front panel, and said rear panel cooperate to define a head aperture;

a first strap associated with said first shoulder strap configured to secure material, said first strap being arranged between said first arm aperture and said head aperture; and wherein said first strap is configured to secure at least a portion of clothing material worn on top of said brassiere between said head aperture and said first arm aperture.

20. A brassiere according to claim 19, further comprising a second strap associated with said second shoulder strap configured to secure material, said second strap being arranged between said second arm aperture and said head aperture; and wherein said second strap is configured to secure at least another portion of clothing material worn on top of said brassiere between said head aperture and said second arm aperture.

* * * * *